US007878611B2

(12) United States Patent
Nakayama

(10) Patent No.: US 7,878,611 B2
(45) Date of Patent: Feb. 1, 2011

(54) DRIVE DEVICE OF LIQUID EJECTION HEAD AND LIQUID EJECTION APPARATUS

(75) Inventor: Kota Nakayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 887 days.

(21) Appl. No.: 11/449,409

(22) Filed: Jun. 8, 2006

(65) Prior Publication Data

US 2007/0085868 A1 Apr. 19, 2007

(30) Foreign Application Priority Data

Oct. 19, 2005 (JP) ..... 2005-304813

(51) Int. Cl.
*B41J 29/38* (2006.01)

(52) U.S. Cl. ..... 347/11; 347/9; 347/14

(58) Field of Classification Search ..... 347/5, 347/9, 10, 11, 14
See application file for complete search history.

(56) References Cited

U.S. PATENT DOCUMENTS

2004/0246287 A1* 12/2004 Usuda ..... 347/14
2005/0285894 A1* 12/2005 Nakayama ..... 347/35

* cited by examiner

*Primary Examiner*—Matthew Luu
*Assistant Examiner*—Jannelle M Lebron
(74) *Attorney, Agent, or Firm*—Fildes & Outland, P.C.

(57) ABSTRACT

A drive device drives a liquid ejection head that ejects recording liquid droplets from nozzles as a result of drive signal voltages being applied to drive elements. The drive device includes a transfer unit that transfers and outputs printing data and an output unit that outputs the result of a comparison where the plural printing data are compared. A liquid ejection apparatus is disclosed with the liquid ejection head drive device.

20 Claims, 8 Drawing Sheets

DRIVE DEVICE OF LIQUID EJECTION HEAD AND LIQUID EJECTION APPARATUS

CROSS-REFERENCE TO RELATED APPLICATION

This application claims priority under 35 USC 199 from Japanese Patent Application No. 2005-304,813, the disclosure of which is incorporated by reference herein.

TECHNICAL FIELD

The present invention relates to a drive device of a liquid ejection head and to a liquid ejection apparatus, and more particularly to a drive device of a liquid ejection head and to a liquid ejection apparatus that drives a liquid ejection head that ejects recording liquid droplets from nozzles disposed with drive elements according to the application of drive signal voltages to those drive elements.

RELATED ART

The piezoelectric format is known as one type of inkjet recording format that records characters and images such as photographs on a recording medium by causing ink droplets ejected from the nozzles of a recording head to adhere to the recording medium. In the piezoelectric format, the deformation of piezoelectric elements that results from the application of drive signal voltages to those piezoelectric elements is transmitted via diaphragms to pressure chambers filled with ink, whereby pressure fluctuations inside the pressure chambers cause the ink droplets to be ejected from the nozzles.

The drive device that drives a piezoelectric recording head is configured by an integrated circuit and the like, which includes a high voltage unit that is driven at a high voltage (e.g., 40 V) in order to drive the piezoelectric elements and a logic unit that includes logic circuits or the like such as shift registers. However, sometimes the logic unit malfunctions due to the effect of noise generated by the logic power supply (e.g., 3.3 V) for driving the logic unit, or else the high voltage unit malfunctions due the effect of noise generated by the high voltage power supply unit for driving the high voltage unit (latch up).

When the high voltage unit latches up, the reference potential in the integrated circuit rises because a huge overcurrent flows to the high voltage unit. As a result, this also causes the logic unit to malfunction.

In order to detect such malfunction of the recording head, a technique is available that detects malfunctions by looping back the output of the final stage of the shift registers of the drive device of the recording head and checking this against a signal inputted to the shift registers to determine whether or not both match.

Further, a technique is available that detects malfunctions by adding a parity to the printing data to be recorded by the recording head and parity-checking the output of the shift registers.

Further, a technique is available that detects malfunctions by detecting when all of the data on a data bus are "1" or "0", since this is often what happens when a an out-of-control situation arises resulting from a malfunction.

In recent years, there has been an increasing trend to lengthen the recording head of inkjet printers, and in accompaniment therewith there has also been the trend to increase the number of integrated circuits in the drive device disposed in the recording head.

Yet when the technology described above in the paragraph is applied to the drive device of a recording head lengthened in this manner, there is the problem that the number of wires for looping back the output of the final stage of shift registers increases as the number of integrated circuits of the drive devices disposed in the recording heads becomes greater, which leads to an increase in cost.

Further, in the technology described above in the paragraph, because a parity is added to the printing data and the output of the shift registers is parity-checked, there have been the problems that compatibility with the control device that outputs printing data to which a parity has not been added becomes poor, and the probability of detecting malfunction in the case of a lengthened recording head becomes low.

Further, in the technology described above in the paragraph, there is the problem that compatibility with malfunction detection becomes poor because all of the data on the data bus do not invariably become "1" or "0" during an out-or-control situation resulting from a malfunction.

Further, when a circuit for detecting malfunction is disposed outside the recording head, that is, in the printer body, the number of signal lines connecting the recording heads and the printer body increase and the processing burden of the control device of the printer body becomes large, which leads to an increase in the cost of the device. Consequently, it is preferable for the detection of malfunction of the drive device of the recording head to be conducted by the drive device of the recording head itself.

SUMMARY

The present invention has been made in view of the above circumstances and provides a liquid ejection head drive device and a liquid ejection apparatus that can reliably detect, with an inexpensive configuration and by the drive device itself, malfunction of a drive device disposed in a recording head.

An aspect of the invention provides a liquid ejection head drive device that drives a liquid ejection head that ejects recording liquid droplets from plural nozzles disposed in correspondence to plural drive elements as a result of drive signal voltages being applied to the plural drive elements by plural drive signal voltage generating units that are disposed in correspondence to the plural drive elements and generate drive signal voltages on the basis of printing data, the liquid ejection head drive device comprising: a transfer unit that transfers printing data of a predetermined transfer data number and outputs the corresponding printing data to the plural drive signal voltage generating units; and an output unit that acquires printing data from plural predetermined positions that are on a transfer path of the transfer unit and are apart a predetermined data number and outputs the result of a comparison where the acquired plural printing data are compared.

Other aspects, features and advantages of the present invention will become apparent from the following description taken in conjunction with the accompanying drawings.

BRIEF DESCRIPTION OF THE DRAWINGS

Preferred embodiments of the present invention will be described in detail based on the following figures, in which:

FIG. 6 is a schematic block diagram of a circuit that outputs an error signal or the like;

DETAILED DESCRIPTION

An example of an embodiment of the present invention will be described in detail below with reference to the drawings.

Figure 1:
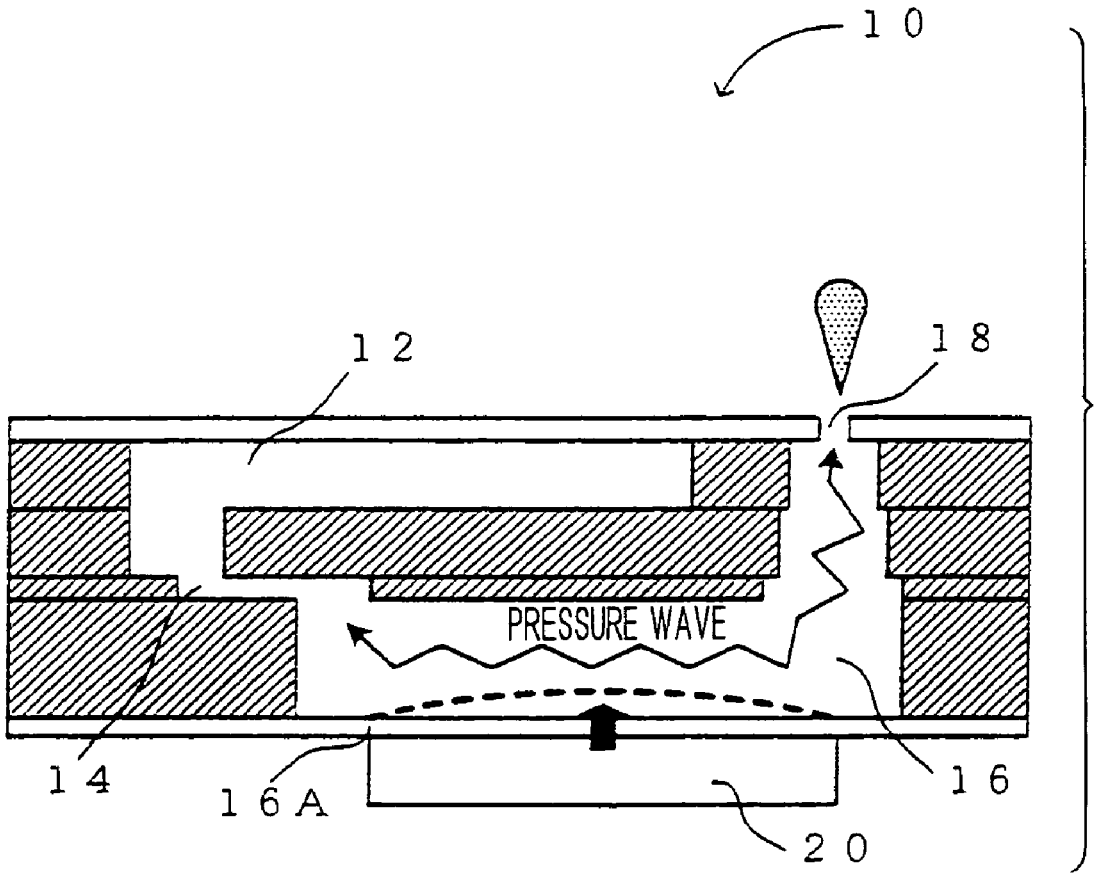
FIG. 1 is a cross-sectional diagram showing the internal configuration of a liquid ejection head.

FIG. 1 shows the internal configuration of a liquid ejection head 10 of an inkjet printer according to an embodiment of the present invention. The liquid ejection head 10 is a long head disposed with numerous nozzles, but because the portions corresponding to the individual nozzles have the same mutual structure, FIG. 1 shows just the portion corresponding to one nozzle.

As shown in FIG. 1, the liquid ejection head 10 includes an ink tank 12 that stores ink supplied via an unillustrated ink supply path. The ink tank 12 is communicated with a pressure chamber 16 via a supply path 14, and the pressure chamber 16 is filled with ink supplied via the supply path 14 from the ink tank 12. Part of the wall of the pressure chamber 16 is configured by a diaphragm 16A, and a piezoelectric element 20 serving as a drive element according to the embodiment is bonded to the diaphragm 16A by adhesion or the like. When a voltage (later-described drive signal voltage) is applied to the piezoelectric element 20, the piezoelectric element 20 becomes displaced, the diaphragm 16A vibrates, the vibration of the diaphragm 16A propagates inside the pressure chamber 16 as a pressure wave, and the ink inside the pressure chamber 16 is ejected as ink droplets via a nozzle 18 communicated with the pressure chamber 16.

Figure 2:
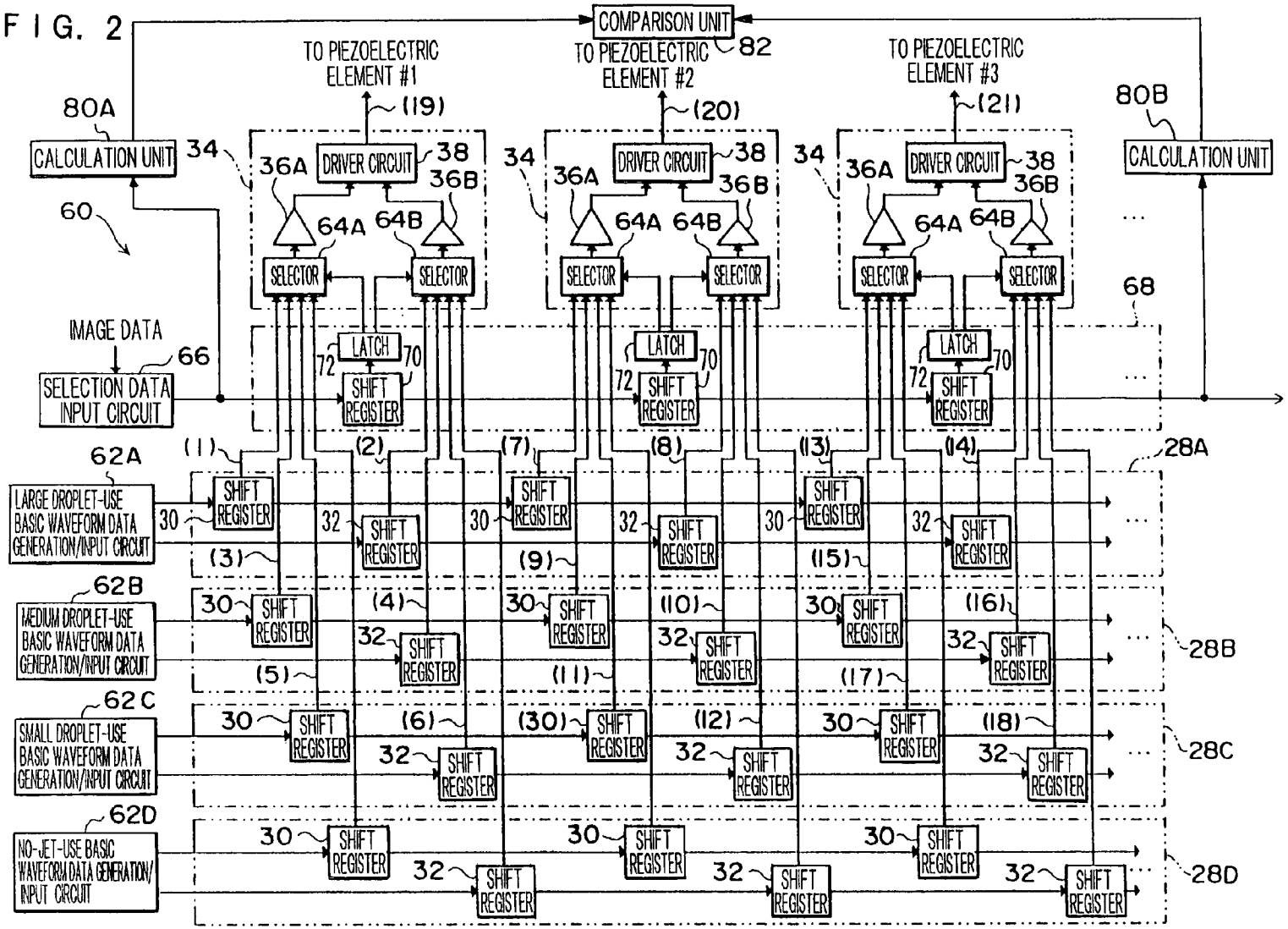
FIG. 2 is a block diagram showing the schematic configuration of a head drive unit.

FIG. 2 shows a head drive unit 60 according to the present embodiment. The head drive unit 60 is a portion that drives the numerous piezoelectric elements disposed in the liquid ejection head 10, and is disposed inside the liquid ejection head 10. The numerous piezoelectric elements disposed in the liquid ejection head 10 are driven by plural head drive units 60 having the same configuration. That is, the numerous piezoelectric elements are divided into groups comprising a predetermined number of piezoelectric elements, and each group of the predetermined number of piezoelectric elements is driven by one head drive unit 60.

The head drive unit 60 includes: drive signal voltage generating units 34 that are numerously disposed in correspondence to the individual piezoelectric elements 20 of the liquid ejection head 10; basic waveform data generation/input circuit for use with large droplets (large droplet-use basic waveform data generation/input circuit) 62A, a medium droplet-use basic waveform data generation/input circuit 62B, a small droplet-use basic waveform data generation/input circuit 62C, and waveform data generation/input circuit for use in non-jetting (a no-jet-use basic waveform data generation/input circuit) 62D, which generate plural types of basic waveform data in accordance with liquid droplet amounts; shift register groups 28A, 28B, 28C and 28D that transfer and supply, to the individual drive signal voltage generation units 34, the plural types of basic waveform data generated by the corresponding basic waveform data generation/input circuits; a selection data input circuit 66 that determines, on the basis of inputted image data, from which of the individual nozzles 18 ink droplets are to be ejected and the liquid droplet amounts (large droplets, medium droplets, small droplets) of the ink droplets to be ejected, and generates and outputs selection data instructing which of the basic waveform data of the large droplet-use, medium droplet-use, small droplet-use, and no-jet-use basic waveform data are to be selected; and a data transfer input unit 68 that transfers the inputted selection data and retains the corresponding selection data in the individual drive signal voltage generating units 34.

Figure 3:
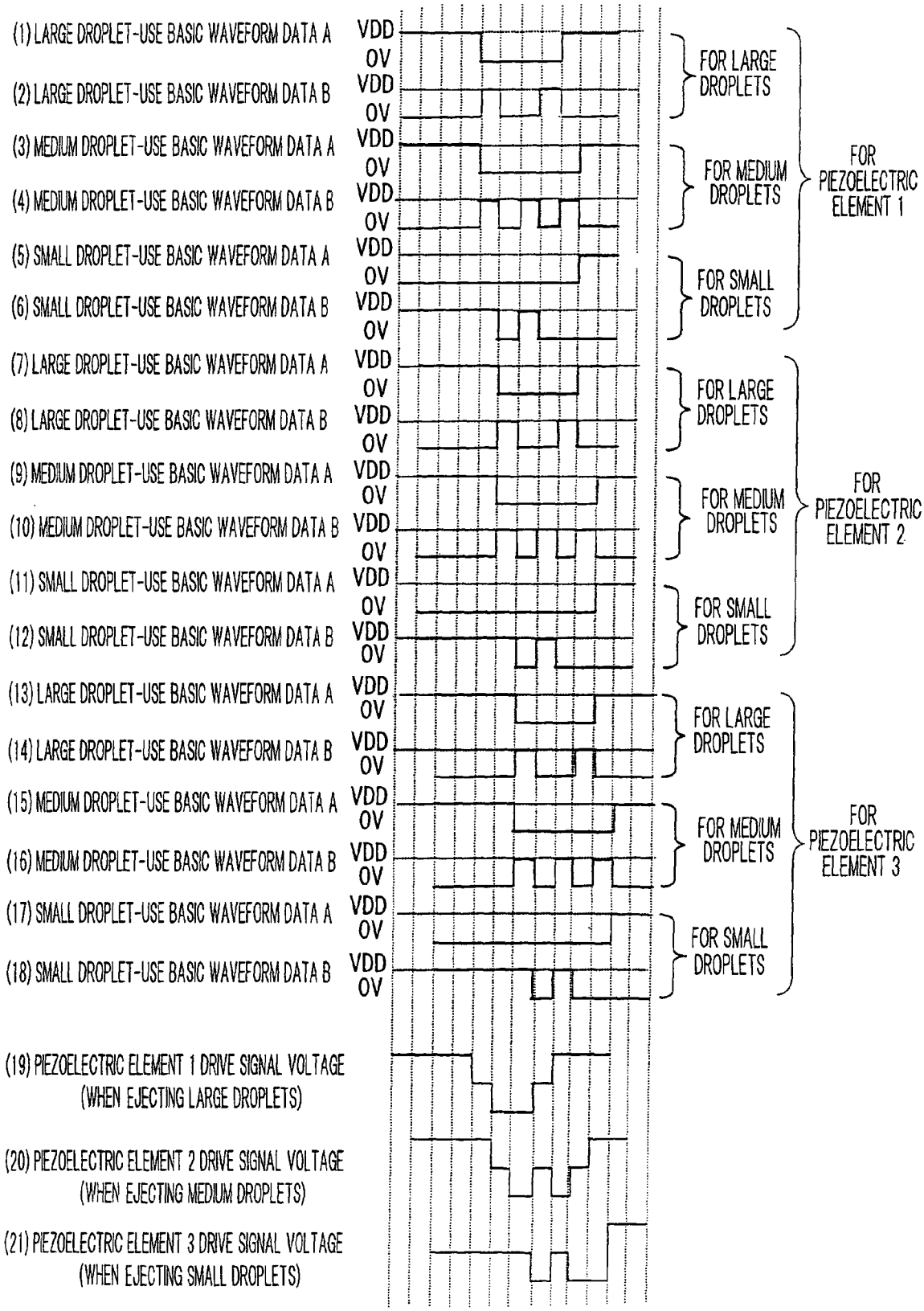
FIG. 3 is a timing chart of data (voltages) flowing through each part of the head drive unit.

In the present embodiment, the basic waveform data are data representing basic waveforms whose voltage level changes in two stages (waveforms serving as the base of the drive signal voltages; see FIG. 3(1) for an example). When the voltage level of the corresponding basic waveform is low (e.g., 0 (V)), the value of the basic waveform data becomes "0", and when the voltage level of the corresponding basic waveform is high (e.g., VDD (V)), the value of the basic waveform data becomes "1". Thus, the basic waveform data represent, with two values, the timing of the change in the voltage level of the corresponding basic waveform and the voltage level during that timing of the change. Each basic waveform data generation/input circuit 62 stores the basic waveform data in an internal memory and repeatedly reads and outputs, 1 bit at a time, the basic waveform data from the internal memory at a timing synchronized with a predetermined clock signal (e.g., when the read bit value is "0", then the output voltage level is 0 (V), and when the read bit value is "1", then the output voltage level is VDD (V), etc.).

Further, two types of basic waveform data representing mutually different basic waveforms are stored in the internal memory of each of the basic waveform data generation/input circuits 62 (for the sake of convenience, one of these two types of basic waveform data will be called basic waveform data A, and the other of these two types of basic waveform data will be called basic waveform data B below). As will be described later, the two types of basic waveform data are inputted to the individual drive signal voltage generating units 34, where they are boosted to mutually different voltage levels, and the basic waveform voltage of the two types of basic waveform voltages that is to be selectively outputted as the drive signal voltage is appropriately switched, whereby a drive signal voltage whose voltage level changes in three stages or more is generated. The two types of basic waveform data represent mutually different basic waveforms that are determined such that a drive signal voltage with a predetermined waveform is obtained (see FIG. 3(1) and (2) for examples), and each of the basic waveform data generation/input circuits 62 repeatedly reads and outputs, 1 bit at a time each, the basic waveform data A and B stored in its internal memory.

The basic waveform data A and B are mutually different in each of the basic waveform data generation/input circuits 62. In the internal memory of the large droplet-use basic waveform data generation/input circuit 62A are stored large droplet-use basic waveform data A and B (see FIG. 3(1) and (2)) for generating drive signal voltages of waveforms to be applied to the piezoelectric elements 20 in order to cause ink droplets of relatively large liquid droplet amounts (large droplets) to be ejected from the nozzles 18. In the internal memory of the medium droplet-use basic waveform data generation/input circuit 62B are stored medium droplet-use basic waveform data A and B (see FIG. 3(3) and (4)) for generating drive signal voltages of waveforms to be applied to the piezoelectric elements 20 in order to cause ink droplets of intermediate liquid droplet amounts (medium droplets) to be ejected from the nozzles 18. In the internal memory of the small droplet-use basic waveform data generation/input circuit 62C are stored small droplet-use basic waveform data A and B (see FIG. 3(5) and (6)) for generating drive signal voltages of waveforms to be applied to the piezoelectric elements 20 in order to cause ink droplets of relatively small liquid droplet amounts (small droplets) to be ejected from the nozzles 18. In the internal memory of the no-jet-use basic waveform data generation/input circuit 62D are stored no-jet-use basic waveform data A and B (not shown) for generating drive signal voltages of waveforms to be applied to the piezoelectric elements 20 in order to prevent fixing of the ink during non-jetting when ink droplets are not ejected from the nozzles 18.

Further, selectors 64A and 64B are disposed in each of the individual drive signal voltage generating units 34 corresponding to the individual piezoelectric elements 20. Input ends of booster circuits 36A are connected to output ends of the selectors 64A, and input ends of booster circuits 36B are connected to output ends of the selectors 64B.

The basic waveform data A and B outputted from the basic waveform data generation/input circuits 62 are inputted to the shift register groups 28A to 28D. Each of the shift register groups 28A to 28D is disposed with a shift register row A, which comprises numerous shift registers 30 that are serially connected and disposed in correspondence to the individual drive signal voltage generating units 34, and a shift register row B, which comprises numerous shift registers 32 that are serially connected and disposed in correspondence to the individual drive signal voltage generating units 34. The basic waveform data A inputted 1 bit at a time to the shift register groups 28A to 28D are inputted to the shift register rows A and sequentially transferred through the shift register rows A at a period synchronized with a predetermined clock signal. Similarly, the basic waveform data B inputted 1 bit at a time to the shift register groups 28 are inputted to the shift register rows B and sequentially transferred through the shift register rows B at a period synchronized with a predetermined clock signal.

Further, output ends of the individual shift registers 30 of the shift register rows A are connected to input ends of the selectors 64A of the corresponding drive signal voltage generating units 34, and output ends of the individual shift registers 32 of the shift register rows B are connected to input ends of the selectors 64B of the corresponding drive signal voltage generating units 34. Consequently, the basic waveform data A and B are inputted to the individual drive signal voltage generating units 34 at a timing shifted one period at a time of the predetermined clock signal.

The booster circuits 36A generate basic waveform voltages A by boosting the inputted basic waveform data A to a predetermined voltage level (voltage level 1). The booster circuits 36B generate basic waveform voltages B by boosting the inputted basic waveform data B to a predetermined voltage level (voltage level 2). Output ends of the booster circuits 36A and 36B are connected to input ends of driver circuits 38, and the basic waveform voltages A and B generated by the booster circuits 36A and 36B are inputted to the driver circuits 38.

The driver circuits 38 generate, on the basis of the inputted basic waveform voltages A and B, drive signal voltages whose voltage level changes in three stages and apply the drive signal voltages to the piezoelectric elements 20 (see FIG. 3(19) to (21) for examples).

The head drive unit 60 is also disposed with the selection data input circuit 66. Image data representing an image to be formed on a recording medium as a result of ink droplets being ejected from the nozzles 18 of the liquid droplet ejection head 10 are inputted to the selection data input circuit 66. The selection data input circuit 66 determines, on the basis of the inputted image data, from which of the individual nozzles 18 ink droplets are to be ejected and the liquid droplet amounts (large droplets, medium droplets, small droplets) of the ink droplets to be ejected. On the basis of the result of that determination, the selection data input circuit 66 generates, for each of the individual drive signal voltage generating units 34, selection data instructing which of the basic waveform data of the large droplet-use, medium droplet-use, small droplet-use, and no-jet-use basic waveform data inputted to the selectors 64A and 64B are to be selected (are to be used to drive the piezoelectric elements 20), and sequentially outputs the generated selection data using the selection data corresponding to a single drive signal voltage generating unit 34 as a unit.

The data transfer input unit 68 is connected to an output end of the selection data input circuit 66, and is configured by a shift register row and numerous latches 72. The shift register row comprises numerous shift registers 70 that are serially connected and disposed in correspondence to the individual drive signal voltage generating units 34. The shift register row transfers, in accordance with a transfer clock, the selection data (printing data) sequentially outputted from the selection data input circuit 66. The latches 72 are connected to output ends of the individual shift registers 70 in the shift register row, retain the selection data outputted from the shift registers 70, and input the selection data to control signal input ends of the selectors 64A and 64B.

The head drive unit 60 is also provided with calculation units 80A and 80B and a comparison unit 82. An input end of the calculation unit 80A is connected to an input end of the data transfer input unit 68, that is, to the output end of the selection data input circuit 66. Consequently, the printing data outputted from the selection data input circuit 66 are sequentially inputted to the calculation unit 80A.

Figure 4A:
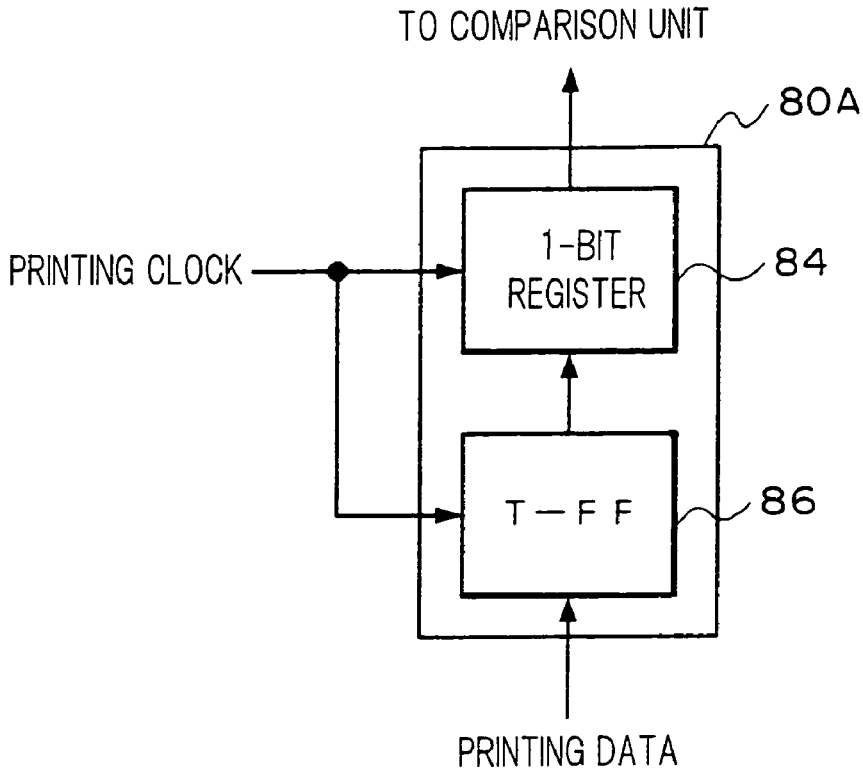
FIG. 4A is a block diagram showing the schematic configuration of one calculation unit.

As shown in FIG. 4A, the calculation unit 80A is configured to include a 1-bit register 84 that stores 1-bit data and a toggle flip-flop (T-FF) 86. The T-FF 86 is a sequential circuit that inverts output at the launch of the inputted printing data when the initial value of the output is "0". Consequently, when an odd number of "1"s (high level) are included in the inputted printing data, the output of the T-FF 86 becomes "1", and when an even number of "1"s are included in the inputted printing data, the output of the T-FF 86 becomes "0". That is, the T-FF 86 functions as a calculation unit that calculates parity data.

Figure 5:
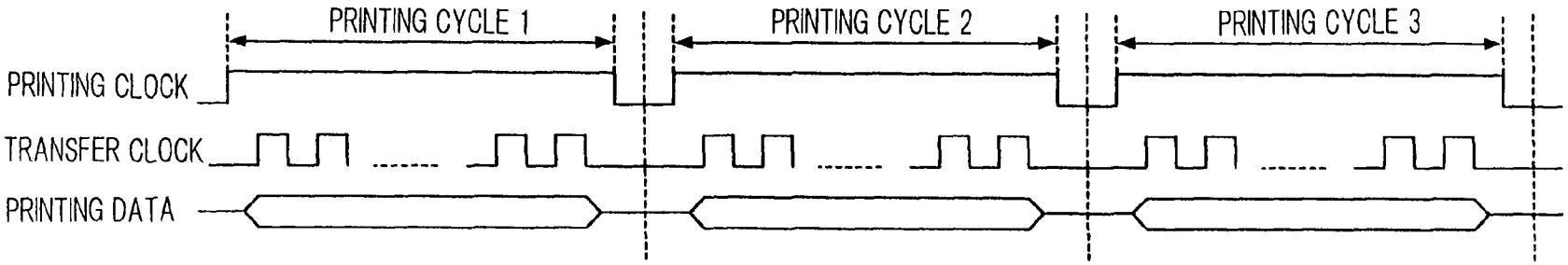
FIG. 5 is a timing chart illustrating a print clock, transfer clock and print data.

The T-FF 86 is configured such that the aforementioned inversion operation is conducted when a printing clock representing whether or not to allow execution of a printing cycle is at a high level and such that the output is reset to "0" when the printing clock becomes a low level. As shown in FIG. 5, the printing data are outputted when the printing clock is at a high level, that is, during a period when printing is allowed.

Further, when the printing clock becomes a low level, the 1-bit register 84 outputs the stored 1-bit data to the comparison unit 82 and imports and retains the output of the T-FF 86.

An output end of the data transfer input unit 68 is connected to an input end of the calculation unit 80B. Consequently, the printing data outputted from the data transfer input unit 68 are sequentially inputted to the calculation unit 80B. It will be noted that the printing data are inputted to the calculation unit 80B delayed a number of clocks corresponding to the number of registers (bit storage number) in the shift register row of the data transfer input unit 68 after the printing data have been inputted to the calculation unit 80A.

Figure 4B:
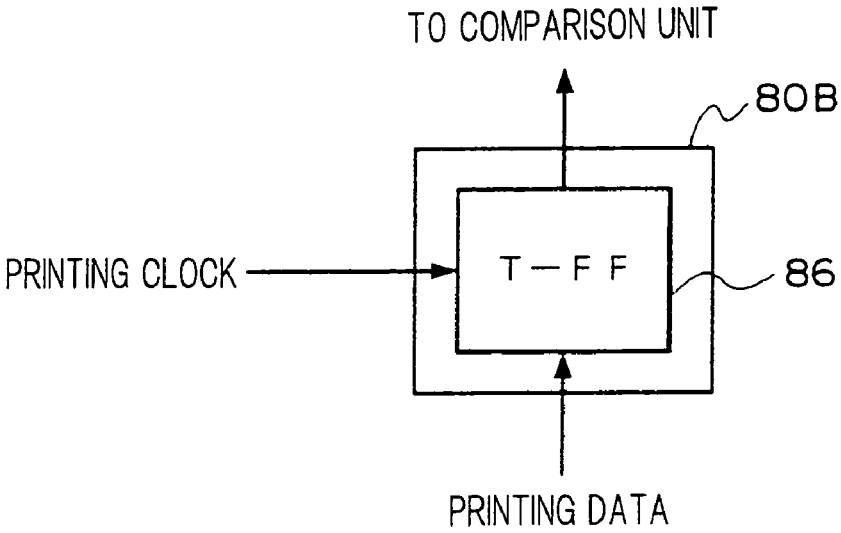
FIG. 4B is a block diagram showing the schematic configuration of another single calculation unit.

As shown in FIG. 4B, the calculation unit 80B is configured to include a T-FF 86. When the printing clock is also inputted to the comparison unit 82 and this signal becomes a low level, the comparison unit 82 compares the 1-bit data outputted from the 1-bit register 84 of the calculation unit 80A and the 1-bit data outputted from the T-FF 86 of the calculation unit 80B. When the data do not match, the comparison unit 82 determines that the head drive unit 60 has malfunctioned and executes later-described predetermined processing.

Next, the operation of the present embodiment will be described. First, the drive control of the liquid ejection head 10 by the head drive unit 60 will be described.

In the head drive unit 60 according to the present embodiment, the selection data are generated and sequentially outputted on the basis of image data by the selection data input circuit 66 prior to the ejection of the ink droplets from the liquid ejection head 10. The selection data sequentially outputted from the selection data input circuit 66 are transferred by the shift register row of the data transfer input unit 68 and retained in the latches 72, whereby the selection data are inputted to the selectors 64A and 64B of the corresponding drive signal voltage generating units 34.

Further, the basic waveform data generation/input circuits 62A to 62D repeatedly read, 1 bit at a time, and sequentially output the basic waveform data A and B (any of the large droplet-use, medium droplet-use, small droplet-use and no-jet-use basic waveform data) stored in the internal memories at a timing synchronized with a predetermined clock signal. The large droplet-use, medium droplet-use, small droplet-use and nojet-use basic waveform data A outputted from the basic waveform data generation/input circuits 62A to 62D are transferred by the shift register rows A of the shift register groups 28A to 28D and inputted at timings shifted by one period each according to the time of the predetermined clock signal to the selectors 64A of the individual drive signal voltage generating units 34. Further, the large droplet-use, medium droplet-use, small droplet-use and no-jet-use basic waveform data B outputted from the basic waveform data generation/input circuits 62A to 62D are transferred by the shift register rows B of the shift register groups 28A to 28D and inputted at timings shifted by one period each according to the time of the predetermined clock signal to the selectors 64B of the individual drive signal voltage generating units 34.

Of the large droplet-use, medium droplet-use, small droplet-use and no-jet-use basic waveform data inputted to the selectors 64A and 64B via the shift register groups 28A to 28D from the basic waveform data generation/input circuits 62A to 62D, the selectors 64A and 64B output, to the booster circuits 36A and 36B, the basic waveform data whose selection has been instructed by the selection data inputted to the control signal input ends via the data transfer input unit 68 from the selection data input circuit 66.

Thus, as shown in FIG. 3(19) to (21), for example, the drive signal voltages that are outputted via the booster circuits 36A and 36B and the driver circuits 38 and are applied to the individual piezoelectric elements 20 on the basis of the basic waveform data outputted from the selectors 64A and 64B have waveforms corresponding to the types of basic waveform data outputted from the selectors 64A and 64B (large droplet-use, medium droplet-use, small droplet-use, and no-jet-use), and the waveforms of the drive signal voltages applied to the individual piezoelectric elements 20 are independently controlled for each of the individual piezoelectric elements 20 in accordance with the selection data inputted to the selectors 64A and 64B of the individual drive signal voltage generating units 34 corresponding to the individual piezoelectric elements 20. It will be noted that FIG. 3(19) to (21) shows a case where, with respect to piezoelectric element 1, a drive signal voltage having a large droplet-use waveform is generated/applied as a result of large droplet-use basic waveform data being selected, and with respect to piezoelectric element 2, a drive signal voltage having a medium droplet-use waveform is generated/applied as a result of medium droplet-use basic waveform data being selected, and with respect to piezoelectric element 3, a drive signal voltage having a small droplet-use waveform is generated/applied as a result of small droplet-use basic waveform data being selected.

The individual nozzles 18 of the liquid ejection head 10 the ink from which droplets are to be ejected, and the liquid droplet amounts of the ink droplets to be ejected, are dependent on the waveform of the drive signal voltage applied to the corresponding piezoelectric element 20, and the sizes of the dots to be formed on the recording medium by the ink droplets ejected from the individual nozzles 18 are dependent on the liquid droplet amounts of the ink droplets ejected from the individual nozzles 18. For this reason, the head drive unit 60 according to the present embodiment can switch the liquid droplet amounts of the ink droplets ejected from the individual nozzles 18 to achieve dot diameter modulation where the sizes of the dots to be formed on the recording medium by the ink droplets ejected from the individual nozzles 18 are switched for each individual nozzle 18 (individual piezoelectric element 20) and in accordance with the image to be formed on the recording medium, and can improve, with this dot diameter modulation, the image quality of the image that is formed on the recording medium.

Next, the malfunction detection control by the head drive unit 60 will be described.

As shown in FIG. 5, when the printing clock becomes a high level, the printing cycle is started and input of the image data to the selection data input circuit 66 is started. Then, the selection data input circuit 66 generates the selection data (i.e., printing data) on the basis of the inputted image data, and sequentially outputs the selection data to the data transfer input unit 68 and the calculation unit 80A.

The printing data sequentially outputted from the selection data input circuit 66 are transferred 1 bit at a time in accordance with the transfer clock shown in FIG. 5 by the shift register row of the data transfer input unit 68, and parity data are calculated by the T-FF 86 of the calculation unit 80A.

Then, when the input of the printing data of the number of registers in the shift register row of the data transfer input unit 68 ends, the printing clock becomes a low level and the printing cycle ends. At this time, the 1-bit data that had been stored in the 1-bit register 84 are outputted to the comparison unit 82, the output of the T-FF 86 of the calculation unit 80A is newly stored in the 1-bit register 84, and the T-FF 86 is reset.

When, for example, the number of registers in the shift register row of the data transfer input unit 68 is equivalent to 256 bits, printing data of 256 bits are outputted from the selection data input circuit 66 in one printing cycle. Thus, the T-FF 86 of the calculation unit 80A calculates parity data with respect to the printing data from the $1^{st}$ bit to the $256^{th}$ bit, and as shown in FIG. 5, at the point in time of t1 after printing cycle 1 has ended, the parity data with respect to the printing data from the $1^{st}$ bit to the $256^{th}$ bit are stored in the 1-bit register 84 of the calculation unit 80A.

Similarly, when printing cycle 2 is started and printing data beginning with the $257^{th}$ bit are outputted from the selection data input circuit 66, the printing data beginning with the $257^{th}$ bit are sequentially transferred by the data transfer input unit 68 and inputted to the T-FF 86 of the calculation unit 80A. Further, the printing data beginning with the $1^{st}$ bit are inputted to the T-FF 86 of the calculation unit 80B. Then, when the printing data from the $257^{th}$ bit to the $512^{th}$ bit are sequentially transferred by the data selection transfer unit 68, the printing clock becomes a low level and printing cycle 2 ends. Thus, in the T-FF 86 of the calculation unit 80A, parity data with respect to the printing data from the $257^{th}$ bit to the $512^{th}$ bit are calculated, and as shown in FIG. 5, at the point in time t2 after printing cycle 2 has ended, parity data with respect to the printing data from the $257^{th}$ bit to the $512^{th}$ bit are stored in the 1-bit register 84 of the calculation unit 80A. Further, in the T-FF 86 of the calculation unit 80B, parity data with respect to the printing data from the $1^{st}$ bit to the $256^{th}$ bit are calculated, and the parity data are outputted to the comparison unit 82 and reset.

When printing cycle 2 ends, the comparison unit 82 compares the parity data with respect to the printing data from the $1^{st}$ bit to the $256^{th}$ bit outputted from the 1-bit register 84 of the calculation unit 80A and the parity data with respect to the printing data from the $1^{st}$ bit to the $256^{th}$ bit outputted from the T-FF 86 of the calculation unit 80B. When both match, the comparison unit 82 determines that the head drive unit 60 is not malfunctioning and continues the printing operation as is. When both do not match, the comparison unit 82 determines that the head drive unit 60 has malfunctioned, due to the aforementioned effect of power supply noise or the like, and executes a predetermined processing.

This predetermined processing can include, for example, at least one of: processing that outputs a clear instruction signal instructing the execution of processing that clears all of the registers in the head drive unit 60 to a device that processes this; processing that outputs an error signal representing the fact that an error has occurred to an unillustrated control device in the body of the inkjet printer; and processing that outputs, to an unillustrated power supply device that supplies power to the head drive unit 60, a power stop signal instructing the stop of the supply of power. From printing cycle 3 below onward is the same.

It will be noted that the invention may also be configured such that, rather than immediately outputting an error signal or the like when the parity data outputted from the calculation unit 80A and the parity data outputted from the calculation unit 80B do not match (when an error has occurred), an error signal or the like is outputted when instances where both sets of parity data do not match continue to occur a predetermined number of times, and such that in other cases an error signal or the like is not outputted and operation is continued as is.

The predetermined number of times is set to a value determined where it is preferable to continue the printing operation when the number of times an error occurs is less than this number of times, and the error is an accidental error resulting from spike noise or the like. Specifically, it is preferable to set the predetermined number of times of two times.

This is due to the following reason. That is, in the case of an inkjet printer, it is inherently easy for noise to arise in the integrated circuit because: a large current flows inside the integrated circuit disposed with the drive device that drives the inkjet printer due to the generation of the energy that jets the liquid droplets; and the distance between the power supply internally disposed in the inkjet printer body and the integrated circuit disposed in the recording head is large. Consequently, if an error is detected only one time, there is the potential for this error to be the result of accidental spike noise. In this case, sometimes it is better to not regard this as a malfunction and to continue the printing operation. For example, even if a few number of pixels are in error, it is preferable to not stop the printing operation as long as there is no conspicuous deterioration in the output image. Conversely, if an error is continuously detected two or more times, the potential for the apparatus itself to be damaged (e.g., damage to the integrated circuit resulting from latch up) and to lead to remarkable deterioration in the output image is high, so that it is preferable to stop the printing operation. That is, it is preferable to avoid stopping the apparatus more than necessary in response to the condition.

By controlling in this manner, the apparatus can be stopped only when absolutely necessary, and printing efficiency can be prevented from dropping.

Table 1 shows output values of the T-FF 86 of the calculation unit 80A and output values of the 1-bit register 84 of the calculation unit 80A at points in time t1, t2 and t3 when there is no malfunction when an odd number of "1"s (high level) are included in printing data of 256 bits outputted in printing cycle 1, an even number of "1"s are included in printing data of 256 bits outputted in printing cycle 2, and an odd number of "1"s are included in printing data of 256 bits outputted in printing cycle 3.

TABLE 1

| | t1 | t2 | t3 |
|---|---|---|---|
| Output Value of T-FF 86 of Calculation Unit 80A | 0 | 1 | 0 |
| Output Value of 1-Bit Register 84 of Calculation Unit 80A | — | 0 | 1 |
| Output Value of T-FF 86 of Calculation Unit 80B | — | 0 | 1 |

As is apparent from Table 1, when there is no malfunction, the output value of the T-FF 86 of the calculation unit 80A at a certain point in time becomes the output value of the 1-bit register 84 of the calculation unit 80A and the output value of the T-FF 86 of the calculation unit 80B after one more printing cycle. Consequently, the comparison unit 82 compares the output value of the 1-bit register 84 of the calculation unit 80A and the output value of the T-FF 86 of the calculation unit 80B from t2 on when two printing cycles have ended.

Figure 6:
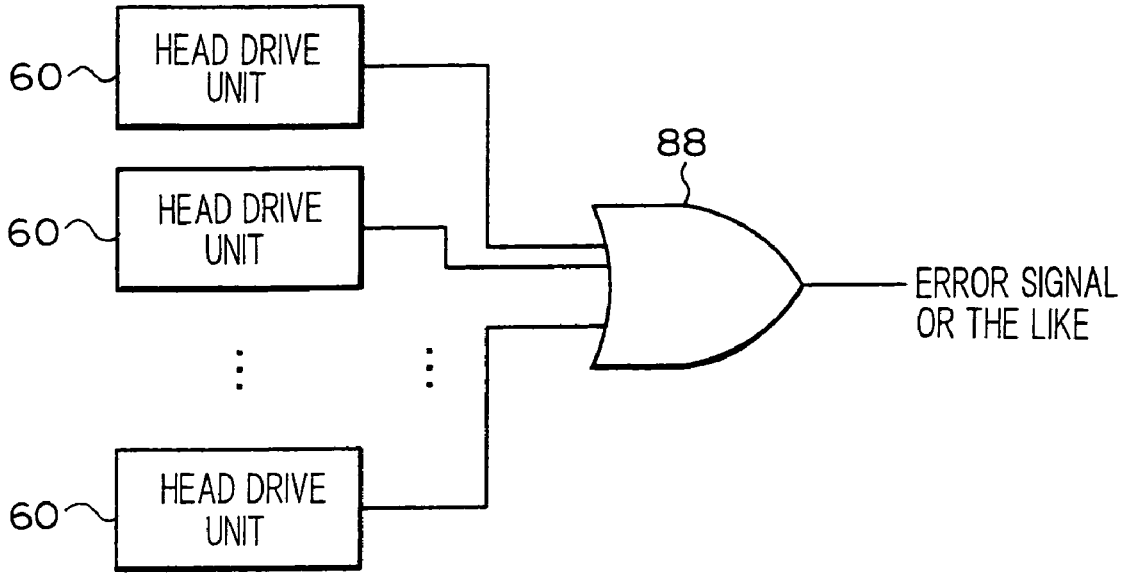

Incidentally, as mentioned above, the liquid ejection head 10 is driven by plural head drive units 60, and each head drive unit 60 executes the above-described malfunction detection control. For this reason, a number of wires (for outputting the error signals and power stop signals) corresponding to the number of head drive units 60 becomes necessary, but as shown in FIG. 6, the invention may also be configured such that an OR circuit 88 is disposed which calculates the logical sum of the error signals and power stop signals from the head drive units 60, so that just the output signal of the OR circuit 88 is outputted to the output destination of the error signal or power stop signal. Thus, the number of wires can be reduced.

In this manner, the calculation units 80A and 80B are connected to both ends of the data transfer input unit 68 that sequentially transfers the printing data, and parity data of the printing data are calculated and compared to detect whether or not the printing data have been normally transferred, to thereby detect malfunction of the head drive unit 60. Thus, malfunction of the head drive unit 60 can be reliably detected by the drive device itself. For this reason, the processing burden of the control device in the body of the inkjet printer can be alleviated. Further, by disposing the OR circuit 88 as shown in FIG. 6, the number of wires for connecting the head drive units 60 and the control device or the power supply device in the body of the inkjet printer can be reduced, whereby an apparatus with a simple and inexpensive structure can be realized.

A case was described above where the data transfer input unit 68 sequentially transferred the printing data from the left side to the right side in FIG. 2, but when the data transfer input unit 68 is configured to sequentially transfer the printing data in both directions and sequentially transfers printing data from the right side to the left side in FIG. 2, malfunction can be detected in the same manner simply by switching the positions of the calculation units 80A and 80B.

Further, a case was described above where the calculation unit 80A was configured by the 1-bit register 84 and the T-FF 84 and where the calculation unit 80B was configured by the T-FF 86. However, the calculation unit 80A may be configured by an n-bit counter that counts the number of times of launch edges of printing data of $2^n$ bits (where n is a positive integer) outputted from the selection data input circuit 66 in one printing cycle (i.e., counts the number of "1"s) and by an n-bit counter that stores the n-bit data, and the calculation unit 80B may be configured by an n-bit register.

Figure 7A:
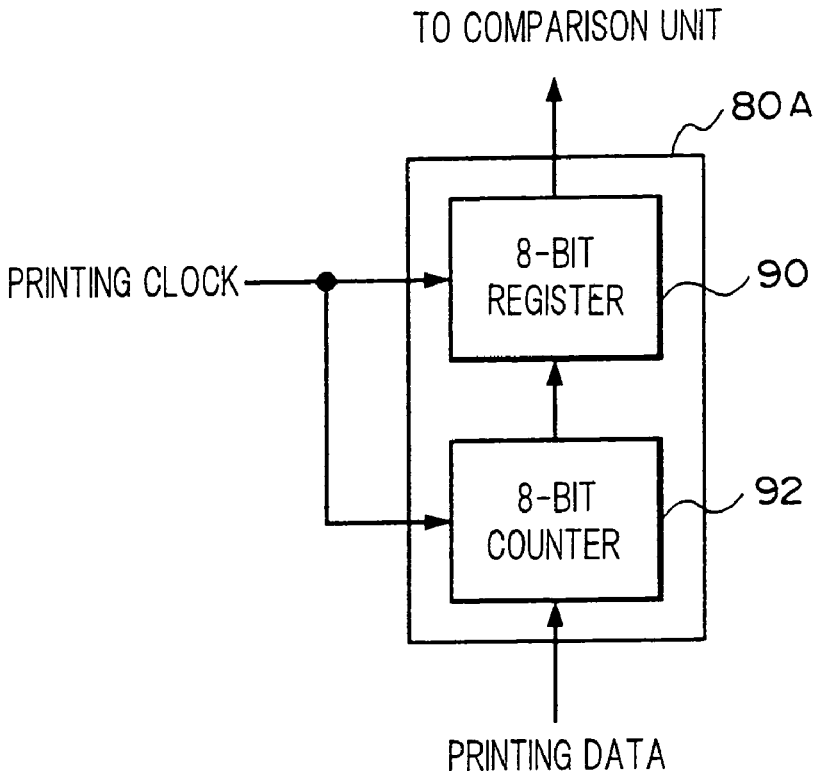
FIG. 7A is a block diagram showing the schematic configuration of a calculation unit according to a modification.
Figure 7B:
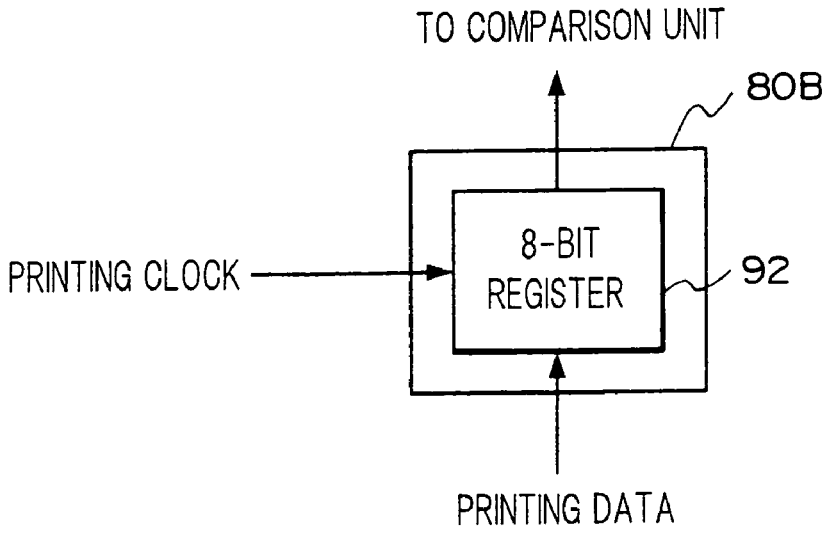
FIG. 7B is a block diagram showing the schematic configuration of another calculation unit according to a modification.

For example, when printing data of 256 bits are outputted from the selection data input circuit 66 in one printing cycle as described above, the calculation unit 80A may be configured by an 8-bit register 90 that stores 8-bit data and by an 8-bit counter 92, as shown in FIG. 7A, and the calculation unit 80B may be configured by an 8-bit counter 92, as shown in FIG. 7B. In this case also, the 8-bit counter 92 of the calculation unit 80A counts the number of "1"s in the 256 bits and outputs this count value to the 8-bit register 90 when the printing clock becomes a low level. The 8-bit register 90 outputs the stored 8-bit data to the comparison unit 82 and newly stores the 8-bit data outputted from the 8-bit counter 92.

Table 2 shows, in decimal numerals, output values of the 8-bit counter 92 of the calculation unit 80A, output values of the 8-bit register 90 of the calculation unit 80A, and output values of the 8-bit counter 92 of the calculation unit 80B at points in time t1, t2 and t3 when there is no malfunction when 256 "1"s are included in printing data of 256 bits outputted in printing cycle 1, ten "1"s are included in printing data of 256 bits outputted in printing cycle 2, and not even one "1" is included in printing data of 256 bits outputted in printing cycle 3.

TABLE 2

| | t1 | t2 | t3 |
|---|---|---|---|
| Output Value of 8-Bit Counter 92 of Calculation Unit 80A | 256 | 10 | 0 |
| Output Value of 8-Bit Register 90 of Calculation Unit 80A | — | 256 | 10 |
| Output Value of 8-Bit Counter 92 of Calculation Unit 80B | — | 256 | 10 |

Because the calculation units are configured by n-bit counters and/or n-bit registers in this manner, not just the fact that a malfunction is occurring but also the number of bits that do not match can be ascertained, and the status of a malfunction can be ascertained in greater detail.

Figure 8A:
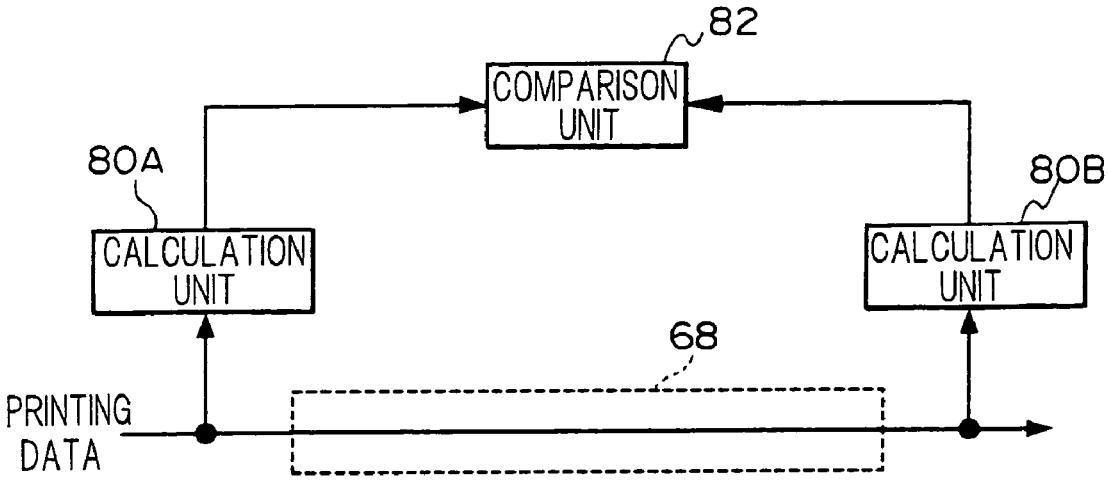
FIGS. 8A and 8B are diagrams for describing positions where the calculation units are connected.
Figure 8B:
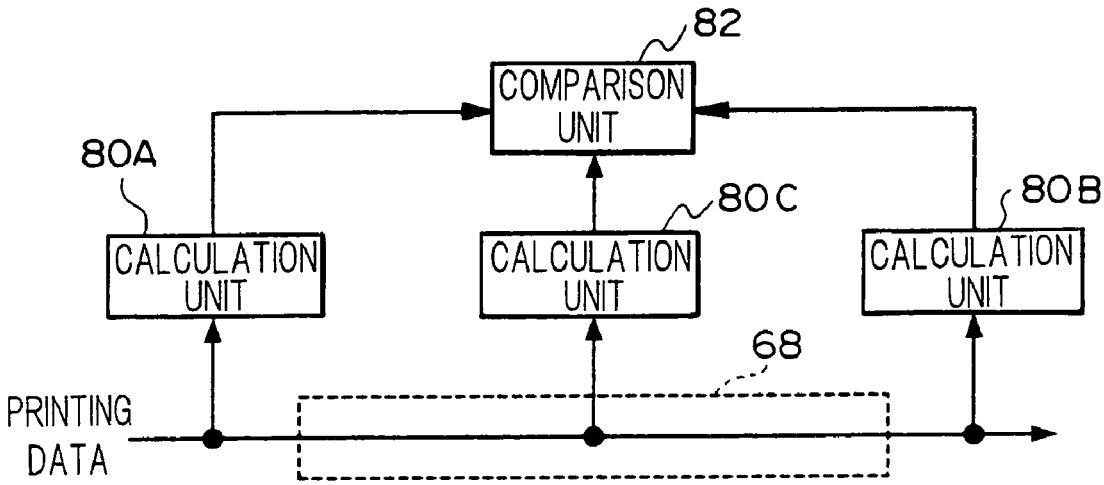

Further, a case was described above where the calculation units 80A and 80B were disposed at both ends of the data transfer input unit 68 as shown in FIG. 8A, but as shown in FIG. 8B, the invention may also be configured such that a calculation unit 80C is disposed in the middle of the data transfer input unit 68 (in the middle of the shift register row) so that malfunction is detected with a finer unit. It will be noted that the calculation unit 80C has the same configuration as that of the calculation unit 80A.

The calculation unit 80C is connected such that when the number of registers in the shift register row of the data transfer input unit 68 is 256 bits, for example, the output of the register in the center of the shift register row of the data transfer input unit 68 (i.e., the $128^{th}$ register counted from the register at the left end of the data transfer input unit 68 in FIG. 8B) is inputted to the calculation unit 80C. Additionally, each time 128 bits of printing data are inputted to the data transfer input unit 68, the comparison unit 82 compares the output value of the calculation unit 80A and the output value of the calculation unit 80C, compares the output value of the calculation unit 80C and the output value of the calculation unit 80B, and conducts the aforementioned predetermined processing when the output values of either comparison do not match.

Because the shift register row is divided in this manner and it is determined whether or not the printing data have been normally transferred per divided section, malfunction of the head drive unit 60 can be rapidly detected. It will be noted that, although the shift register row is divided into sections in the case of FIG. 8B, the shift register row may also be divided into three or more sections as long as the lengths of the divisional sections are equal. The greater the number of divisions there are, the more rapidly malfunction of the head drive unit 60 can be detected.

While the present invention has been illustrated and described with respect to some specific embodiments thereof, it is to be understood that the present invention is by no means limited thereto and encompasses all changes and modifications which will become possible within the scope and spirits of the present invention.

What is claimed is:

1. A liquid ejection head drive device that drives a liquid ejection head that ejects recording liquid droplets from a plurality of nozzles, the liquid ejection head drive device comprising:

a plurality of drive elements each disposed in correspondence to one of the plurality of nozzles and causing the respective nozzles to eject recording liquid droplets as a result of drive signal voltages being applied thereto; and a drive circuit, the drive circuit comprising a plurality of drive signal voltage generating units that are each disposed in correspondence to one of the plurality of drive elements and apply drive signal voltages, that are generated on the basis of printing data, to the corresponding drive element, a data transfer unit that transfers printing data of a predetermined number of units of transfer data along a data path that is disposed inside the drive circuit and that has therealong a first plurality of output positions each disposed in correspondence to one of the plurality of drive signal voltage generating circuits, and a second plurality of output positions for comparison of printing data, that are distinct from the first plurality of output positions and are apart from each other by the predetermined number of units of transfer data, the data transfer unit outputting to each of the plurality of drive signal voltage generating units the printing data corresponding therewith via the corresponding one of the first plurality of output positions on the data path, and an output unit that acquires printing data from the second plurality of output positions, compares the plurality of acquired printing data and outputs the result of the comparison.

2. The liquid ejection head drive device of claim 1, wherein the output unit outputs the result of the comparison where the plurality of acquired printing data are compared each time printing data of the predetermined number of units of data being transferred between the second plurality of output positions are transferred.

3. The liquid ejection head drive device of claim 2, wherein the output unit comprises:

a plurality of parity data calculation units that calculate parity data of the printing data acquired from the second plurality of output positions; and a comparison unit that compares the plurality of parity data calculated by the plurality of calculation units.

4. The liquid ejection head drive device of claim 2, wherein the output unit comprises:

a plurality of counter units that count the number of bits that are "0" or "1" in the printing data acquired from the plurality of predetermined positions; and a comparison unit that compares a plurality of count values counted by the plurality of counter units.

5. The liquid ejection head drive device of claim 2, wherein when the acquired plurality of printing data do not match, the output unit outputs at least one of: a clearing instruction signal, instructing processing that clears all of the printing data in the transfer unit; an error signal, representing the fact that an error has occurred; or a power stop signal, instructing stopping of the supply of power to the drive device.

6. The liquid ejection head drive device of claim 2, wherein the second plurality of output positions comprise three or more predetermined positions disposed at equidistant intervals on the transfer path, and the output unit outputs the result of the comparison where the acquired plural printing data are compared each time printing data of the predetermined number of data units being transferred between adjacent predetermined positions are transferred.

7. The liquid ejection head drive device of claim 6, wherein the output unit comprises:

a plurality of parity data calculation units that calculate parity data of the printing data acquired from the second plurality of output positions; and a comparison unit that compares the plurality of parity data calculated by the plurality of calculation units.

8. The liquid ejection head drive device of claim 6, wherein the output unit comprises:

a plurality of counter units that count the number of bits that are "0" or "1" in the printing data acquired from the plurality of predetermined positions and a comparison unit that compares a plurality of count values counted by the plurality of counter units.

9. The liquid ejection head drive device of claim 6, wherein when the acquired plurality of printing data do not match, the output unit outputs at least one of: a clearing instruction signal, instructing processing that clears all of the printing data in the transfer unit; an error signal, representing the fact that an error has occurred; or a power stop signal, instructing stopping of the supply of power to the drive device.

10. The liquid ejection head drive device of claim 1, wherein the output unit comprises:

a plurality of parity data calculation units that calculate parity data of the printing data acquired from the second plurality of output positions; and a comparison unit that compares the plurality of parity data calculated by the plurality of calculation units.

11. The liquid ejection head drive device of claim 10, wherein when the acquired plurality of printing data do not match, the output unit outputs at least one of: a clearing instruction signal, instructing processing that clears all of the printing data in the transfer unit; an error signal, representing the fact that an error has occurred; or a power stop signal, instructing stopping of the supply of power to the drive device.

12. The liquid ejection head drive device of claim 1, wherein the output unit comprises:

a plurality of counter units that count the number of bits that are "0" or "1" in the printing data acquired from the plurality of predetermined positions; and a comparison unit that compares a plurality of count values counted by the plurality of counter units.

13. The liquid ejection head drive device of claim 12, wherein when the acquired plurality of printing data do not match, the output unit outputs at least one of: a clearing instruction signal, instructing processing that clears all of the printing data in the transfer unit; an error signal, representing the fact that an error has occurred; or a power stop signal, instructing stopping of the supply of power to the drive device.

14. The liquid ejection head drive device of claim 1, wherein the transfer unit is configured to transfer the printing data in a forward and backward direction along the transfer path.

15. The liquid ejection head drive device of claim 14, wherein when the acquired plurality of printing data do not match, the output unit outputs at least one of: a clearing instruction signal, instructing processing that clears all of the printing data in the transfer unit; an error signal, representing the fact that an error has occurred; or a power stop signal, instructing stopping of the supply of power to the drive device.

16. The liquid ejection head drive device of claim 1, wherein when the acquired plurality of printing data do not match, the output unit outputs at least one of: a clearing instruction signal, instructing processing that clears all of the printing data in the transfer unit; an error signal, representing the fact that an error has occurred; or a power stop signal, instructing stopping of the supply of power to the drive device.

17. The liquid ejection head drive device of claim 16, wherein a plurality of drive units that each include one of the transfer unit and one of the output unit are disposed inside the liquid ejection head, and the liquid ejection head drive device further comprises a signal output unit that calculates and outputs the logical sum of the signals outputted from the plurality of output units.

18. The liquid ejection head drive device of claim 16, wherein the output unit outputs the at least one of the signals when the number of instances where the acquired plurality of printing data do not match continues a predetermined number of times.

19. The liquid ejection head drive device of claim 18, wherein a plurality of drive units that each include one of the transfer unit and one of the output unit are disposed inside the liquid ejection head, and the liquid ejection head drive device further comprises a signal output unit that calculates and outputs the logical sum of the signals outputted from the plurality of output units.

20. A liquid ejection apparatus comprising:

a liquid ejection head comprising a plurality of nozzles and a plurality of drive elements each disposed in correspondence to one of the plurality of nozzles and causing the respective nozzles to eject recording liquid droplets as a result of the drive signal voltages being applied thereto; and a drive circuit that drives the liquid ejection head, and comprises a plurality of drive signal voltage generating units that are each disposed in correspondence to one of a plurality of drive elements and apply drive signal voltages, that are generated on the basis of printing data, to a corresponding drive element;

a data transfer unit that transfers printing data of a predetermined number of units of transfer data along a data path that is disposed inside the drive circuit, and that has therealong a first plurality of output positions each associated with one of the drive signal voltage generating circuits, and a second plurality of output positions for comparison of printing data, that are distinct from the first plurality of output positions and are apart from each other by the predetermined number of units of transfer data., the data transfer unit outputting to each of the plurality of drive signal voltage generating units the printing data corresponding therewith via an associated one of the first plurality of output positions on the data path, and an output unit that acquires printing data from the second plurality of output positions, compares the plurality of acquired printing data and outputs the result of the comparison.

* * * * *